US006584810B2

(12) United States Patent
Nakahata et al.

(10) Patent No.: US 6,584,810 B2
(45) Date of Patent: Jul. 1, 2003

(54) KNITTING MEMBER SELECTING ACTUATOR OF KNITTING MACHINE

(75) Inventors: Sadamu Nakahata, Osaka (JP); Hiroyuki Ueyama, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 10/239,025

(22) PCT Filed: Mar. 26, 2001

(86) PCT No.: PCT/JP01/02435

§ 371 (c)(1),
(2), (4) Date: Sep. 18, 2002

(87) PCT Pub. No.: WO01/75202

PCT Pub. Date: Oct. 11, 2001

(65) Prior Publication Data

US 2003/0037576 A1 Feb. 27, 2003

(30) Foreign Application Priority Data

Mar. 31, 2000 (JP) ..... 2000-96310

(51) Int. Cl.[7] ..... D04B 15/78
(52) U.S. Cl. ..... 66/75.2; 66/219
(58) Field of Search ..... 66/218, 219, 220, 66/221, 232, 64, 75.1, 75.2

(56) References Cited

U.S. PATENT DOCUMENTS 4,686,839 A * 8/1987 Schmid ..... 66/75.2
4,715,198 A * 12/1987 Ploppa et al. ..... 66/75.2
4,905,484 A * 3/1990 Schindler ..... 66/220
4,989,424 A * 2/1991 Furia ..... 66/219
5,694,792 A * 12/1997 Nakamori et al. ..... 66/75.1
5,802,878 A * 9/1998 Nakamori et al. ..... 66/64
5,819,559 A * 10/1998 Nakamori et al. ..... 66/232

FOREIGN PATENT DOCUMENTS

| | | |
|---|---|---|
| JP | 51-102151 | 9/1976 |
| JP | 52-50309 | 12/1977 |
| JP | 1-38898 | 8/1989 |
| JP | 2-191750 | 7/1990 |
| JP | 2-60777 | 12/1990 |
| JP | 5-321102 | 12/1993 |
| JP | 9-241952 | 9/1997 |
| JP | 2736640 | 1/1998 |

* cited by examiner

*Primary Examiner*—Danny Worrell
(74) *Attorney, Agent, or Firm*—Rothwell, Figg, Ernst & Manbeck

(57) ABSTRACT

In a knitting member selection actuator (1) of a knitting machine, there is provided between a pair of yokes a magnetic property means (35*a*, 35*b*, 45*a*, 55*a*, 55*b*) for making a magnetic reluctance between the confronting yokes (32*a*, 32*b*, 42*a*, 42*b*, 52*a*, 52*b*) of an uncontrolled attraction region (7, 8, 9) larger than a magnetic reluctance between the yokes of the uncontrolled attraction region and the knitting member attracted to attraction surfaces and also smaller than a magnetic reluctance between the yokes of the uncontrolled attraction region and attraction surfaces of the adjacent controlled attraction region (5, 6).

4 Claims, 7 Drawing Sheets

KNITTING MEMBER SELECTING ACTUATOR OF KNITTING MACHINE

TECHNICAL FIELD

The present invention relates to an actuator used for selecting knitting members, including a selector and a knitting needle, built in a knitting machine.

BACKGROUND ART

A large number of knitting needles are arranged in series on a needle bed of a knitting machine. The knitting needles are selected in accordance with knitting data by a selection device which is mounted on a carriage to move in reciprocation over the needle bed and are operated accordingly, so as to knit a certain pattern, such as a jacquard pattern and a structure pattern. Needle selection actuators built in the needle selection device fall into two types. One is the type of selecting needles by making a magnetic attraction holding of the selectors associated with the needles necessary for the knitting by energizing coil magnetic poles. Another one is the type of selecting needles by releasing the magnetic attraction holding of the selectors associated with the needles necessary for the knitting by energizing the coil magnetic poles. Of these two types, the former one is called "the electromagnet-energized magnetic attraction holding", and the latter one is called "the electromagnet-energized magnetic attraction release". The present invention is directed to the latter type of needle selection device.

FIG. 4 shows a vertical sectional view of a needle bed and a carriage of a flat knitting machine using the electromagnet-energized magnetic attraction release type electromagnet for the needle selection actuator. FIG. 5 shows a view of the needle selection actuator as viewed from the attraction surface side. FIG. 6 shows a sectional view taken along line vi—vi of FIG. 5. FIG. 7 shows a sectional view taken along line vii—vii of FIG. 5.

Knitting members, such as a needle 72, a needle jack 73, a select jack 74 and a selector 75, are slidably accommodated in needle grooves formed in a needle bed 71. The selector 75 is inserted in the needle groove, with its elastic leg 79 compressed and deformed between bands 77, 78 and the selector jack 74 which are fitted in the needle bed 71, so that its armature 83 which is magnetically attracted by a needle selection actuator 81 can always be biased upwardly so as to release from the needle selection actuator 81.

The needle selection actuator 81 is fixed to a bracket 92 mounted on the bottom of a cam plate 91 of a carriage 90 through a flange 86 mounted on a case 85. Attraction surfaces 111*a*, 111*b* of the needle selection actuator 81 confront the armature 83 of the selector. When the carriage 90 is moved in reciprocation for knitting, a butt 95 of the selector 75 is pressed into the needle groove against the upward biasing force from the elastic leg 79 of the selector by a selector return cam (not shown) mounted on the cam plate 91 of the carriage confronting the selector 75. This puts the armature 83 into a position where the armature 83 is magnetically attracted and held on the attraction surfaces 111*a*, 111*b* of the needle selection actuator 81. Along with the movement of the carriage 90, the armature 83 is led to a needle selection part in that state. When the armature of the selector corresponding to a required knitting needle reaches the position over the coil magnetic pole of a first needle selection part or a second needle selection part, the coil magnetic poles are energized to cancel out magnetic flux of permanent magnet, so as to release the armature 83 from the attraction surface. As a result of this, the butt 95 of the selector is raised up over the needle bed to engage with a raising cam (not shown) of the trailing selector, so as to advance and push the select jack up to its intermediate position or its advanced position. The raising cam is mounted on each of the first needle selection part and the second needle selection part. The distance the selector is pushed up by the raising cam varies depends on the raising cam selected. The first raising cam serves to push the selector jack up to the intermediate position and the second raising cam serves to push the selector jack up to the advanced position. This can provide the three-way knitting, i.e., knit, tuck and miss, within a single course.

To make the required needle selection for this three-way knitting, the needle selection actuator 81 is provided, in its case 85, with a first controlled attraction region 105 and a second controlled attraction region 106, each including coil magnetic poles in its magnetic circuit, and three uncontrolled attraction regions 107, 108 and 109 which include no magnetic pole in their magnetic circuits. Each of the attraction regions has the flat attraction surfaces 111*a* (133*a*, 116*a*, 143*a*, 126*a*, 153*a*) and 111*b* (133*b*, 116*b*, 143*b*, 126*b*, 153*b*) arranged in two rows at sides thereof confronting the armature 83 of the selector.

The controlled attraction regions 105, 106 comprise permanent magnets 113, 123 disposed on the base of the case 85 and coil magnetic poles 115*a*; 115*b*, 124*a*; 124*b* which confront each other across the permanent magnets and around which coils 114*a*; 114*b*, 124*a*; 124*b* are wound. The coil magnetic poles have, on front ends thereof, attraction surfaces 116*a*; 116*b*, 126*a*; 126*b* (the first needle selection part and the second needle selection part). The uncontrolled attraction regions 107–109 comprise permanent magnets 131, 141, 151 and side yokes L 132*a*, 132*b*, side yokes R 152*a*, 152*b* and center yokes 142*a*, 142*b*. The yokes have, on front ends thereof, attraction surfaces 133*a*; 133*b*, 143*a*; 143*b*, and 153*a*; 153*b*, respectively. The attraction surfaces are magnetized by their respective permanent magnets, and one of the two parallel rows of attraction surfaces is magnetized as the N-pole and the other is magnetized as the S-pole. Thin copper plates 160 are inserted in between the attraction surfaces of the attraction regions 105–109, to prevent the magnetic fluxes generated in the uncontrolled attraction regions from leaking to the adjacent attraction surfaces of the controlled attraction regions, so as to present the five attraction regions mentioned above in the form of independent magnetic circuits. 110*a*, 110*b* denotes protectors.

The needle selection actuator 81 thus constructed operates as follows for needle selection. The armature 83 of the selector is displaced by the return cam mounted on the carriage 90 against the biasing force and is brought into abutment with the attraction surfaces 111*a*, 111*b* of the needle selection actuator 81. In the uncontrolled attraction regions, the magnetic flux flows from the attraction surface of the yoke on the N-pole side to the attraction surface of the yoke on the S-pole side through the selector to magnetically attract the selector to the attraction surface and hold it thereon. When the carriage 90 travels further in this state and the armature 83 of the selector is led to the position over the attraction surface 116 of the first needle selection part or the attraction surface 126 of the second needle selection part, the coil magnetic poles are energized for demagnetization, so as to release the selector from the attraction surface 116, 126.

The leakage of the magnetic flux from each of the attraction surfaces of the uncontrolled attraction regions 107–109 on S-pole side thereof varies depending on the number of selectors to be magnetically attracted to the attraction surfaces 133, 143, 153. As the number of selectors to be magnetically attracted decreases, the leakage of the magnetic flux from the attraction surfaces 133*a*, 143*a*, 153*a* on the S-pole side increases. Increase in leakage of the magnetic flux will cause a part of the magnetic flux to flow to the attraction surface 116*a*, 126*a* of the adjacent controlled attraction regions 105, 106 beyond the copper plates 160. Due to this, more electric current allowing for the leakage of the magnetic flux is required for the release of the selector. Conversely, as the number of selectors to be magnetically attracted increases, the leakage of the magnetic flux from the attraction surfaces 133*a*, 143*a*, 153*a* decreases. Accordingly, the selectors cannot be released unless the amount of current is decreased. Since the number of selectors to be magnetically attracted varies depending on the design (needle selection pattern) of e.g. a jacquard pattern or a structure pattern, the variation of the number of selectors to be magnetically attracted is unavoidable. Because of this, when the current passing through the coil magnetic poles 115, 125 is kept at a constant value, there arises the problem that the selector to be released from the attraction surface is not released therefrom to cause needle selection errors.

For example, Japanese Laid-open (Unexamined) Patent Publication No. Hei 9(1997)-241952 discusses on this problem and discloses the needle selection device wherein a coil current required for the release of the selector is determined in such a manner that after the number of selectors magnetically attracted in the uncontrolled attraction regions is evaluated from the needle selection pattern, the current value to pass through the coil magnetic poles is controlled based on that evaluated value. Japanese Laid-open (Unexamined) Patent Publication No. Sho 62(1987)-263358 discloses the device wherein a sensor, such as a hall element, for detecting an amount of magnetic flux in the controlled attraction region is disposed in the vicinity of attraction surface of the coil magnetic pole confronting the selector, to measure the magnetic flux that varies every hour. The measured values of the magnetic flux are fed back to determine optimum demagnetization so that the selectors can be released from the attraction surfaces, irrespective of the number of selectors magnetically attracted.

In the former needle selection device, an additional current for canceling out a leaked magnetic flux is required for making a current control in consideration of the leakage of the magnetic flux and, as a result, the required current is increased. On the other hand, in the latter device, since the sensor is disposed in the vicinity of the attraction surface of the coil magnetic pole, the device itself is increased in size and also a control system for feedback is additionally required.

In consideration of the problems mentioned above, the present invention has been made. It is the object of the present invention to provide a needle selection actuator for knitting members, such as a knitting needle, of the knitting machine that can always keep the current to pass through the coil magnetic poles at a constant value or can reduce the current range.

DISCLOSURE OF THE INVENTION

The present invention provides a knitting member selection actuator of a knitting machine comprising at least one controlled attraction region in which a pair of coil magnetic poles, each having an attraction surface at a front end thereof, are arranged in parallel to sandwich a permanent magnet therebetween, and uncontrolled attraction regions which are placed at lateral sides of the controlled attraction region and in which a pair of yokes, each having an attraction surface at a front end thereof, are arranged in parallel to sandwich a permanent magnet therebetween and no coil magnetic pole is included in their magnetic circuit, wherein the pair of coil magnetic poles of the controlled attraction region are energized to cancel out magnetic flux of the attraction surface generated by the permanent magnet, so as to release a knitting member, such as a selector, from the attraction surface, so as to select the knitting member, and wherein there is provided between the pair of yokes magnetic property means for making a magnetic reluctance between the confronting yokes of the uncontrolled attraction region larger than a magnetic reluctance between the yokes of the uncontrolled attraction region and the knitting member attracted to the attraction surface and also smaller than a magnetic reluctance between the yokes of the uncontrolled attraction region and the attraction surfaces of the adjacent controlled attraction region.

According to the present invention, the magnetic property means arranged between the yokes of the uncontrolled attraction region provides a magnetic reluctance between the confronting yokes of the uncontrolled attraction region smaller than a magnetic reluctance between the yokes of the uncontrolled attraction region and the attraction surfaces of the adjacent controlled attraction region. As a result of this, when the selector (knitting member) is not attracted to the attraction surface of the uncontrolled attraction region, a sizable percentage of magnetic flux generated by the permanent magnet of the uncontrolled attraction region is allowed to flow to the opposed yoke through this magnetic property means. Also, since the magnetic property means provides a magnetic reluctance between the yokes larger than a magnetic reluctance between the yokes of the uncontrolled attraction region and the selector attracted to the attraction surface, the magnetic flux generated from the permanent magnet is allowed to flow to the opposed yoke through the selector, and as such can allow the selector to be attracted to and held on the attraction surface. Thus, since the magnetic flux generated from the permanent magnet in the uncontrolled attraction region flows as mentioned above, the magnetic flux can be prevented from leaking to the attraction surface of the adjacent controlled attraction region. As a result of this, there is no need to make a control of an electric current value to allow for leakage of the magnetic flux or make a feedback control of detecting leakage of the magnetic flux by provision of a sensor and feeding back that leaked magnetic flux, differently from the conventional selection actuator. Thus, the current range of the coil control current required for the release of the selector can be reduced or the required coil current can be kept constant.

Preferably, the magnetic property means is formed by a part of the yoke being thickened along a widthwise direction of the attraction surface to form a thick-walled part therealong so that an interval between the confronting yokes at the thick-walled part can become smaller than at the remaining parts. According to this construction, since the magnetic property means is formed by a part of the yoke being increased in thickness and being integrally formed with the yoke, a component count can be reduced and also an assembly of the actuator can be facilitated.

The magnetic property means may be formed by a spacer disposed between the confronting yokes. This can provide the result that an appropriate spacer to meet the requirements for the permissible magnetic property can be properly selected in accordance with kinds of the knitting member and properties of material thereof and built in the actuator.

Further preferably, the magnetic property means is provided along the attraction surface in such a manner as to form a part of the attraction surface. This can provide the result of enabling the contact area of the attraction surface with the selector to be enlarged to the extent corresponding to the magnetic property means, thus enabling the selector to be attracted and held further reliably.

BEST MODE FOR CARRYING OUT THE INVENTION

Figure 1:
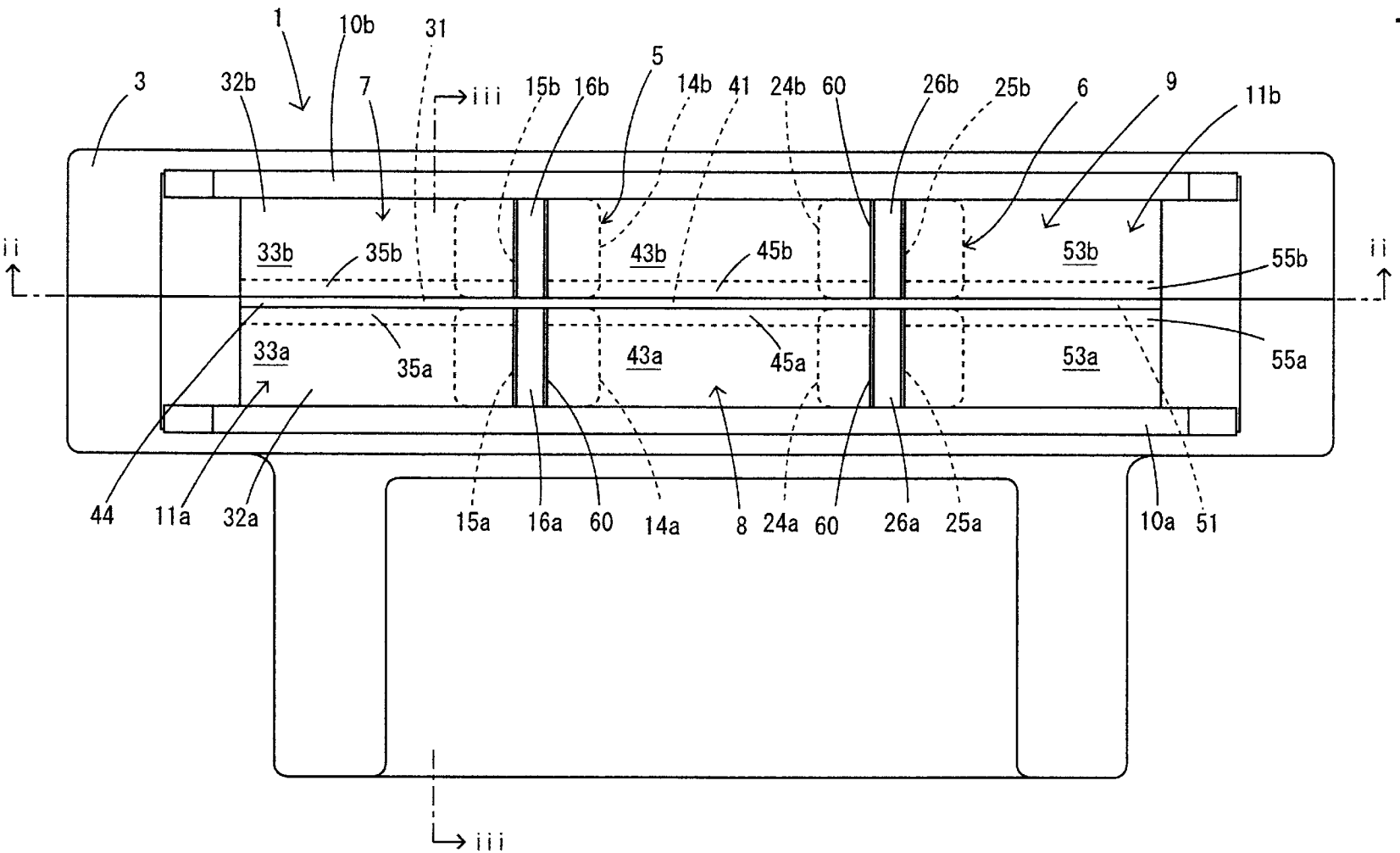
FIG. 1 shows a needle selection actuator of an embodiment of the present invention as viewed from the attraction surface side.
Figure 2:
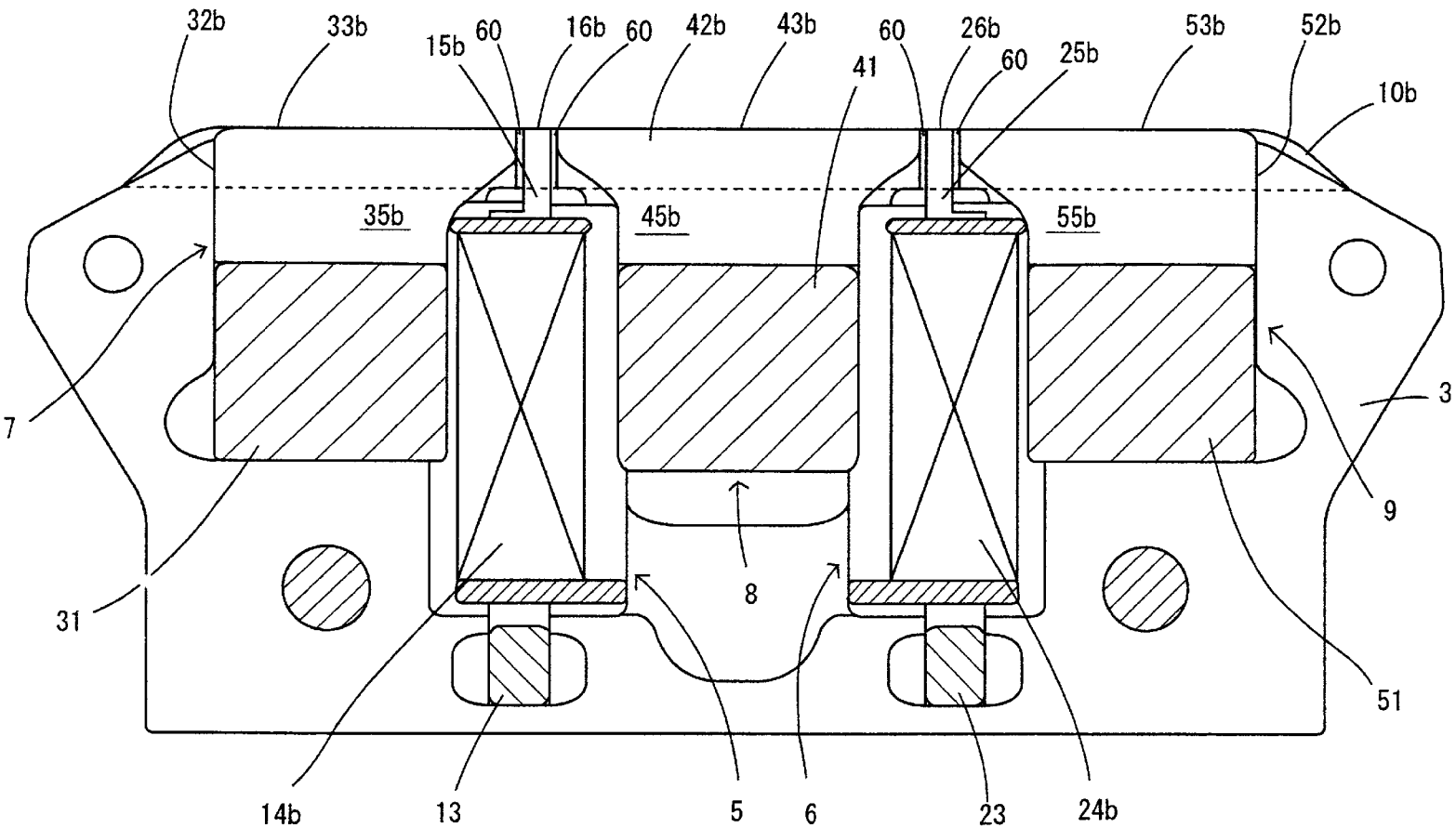
FIG. 2 shows a sectional view of the same taken along line ii—ii of FIG. 1.
Figure 3:
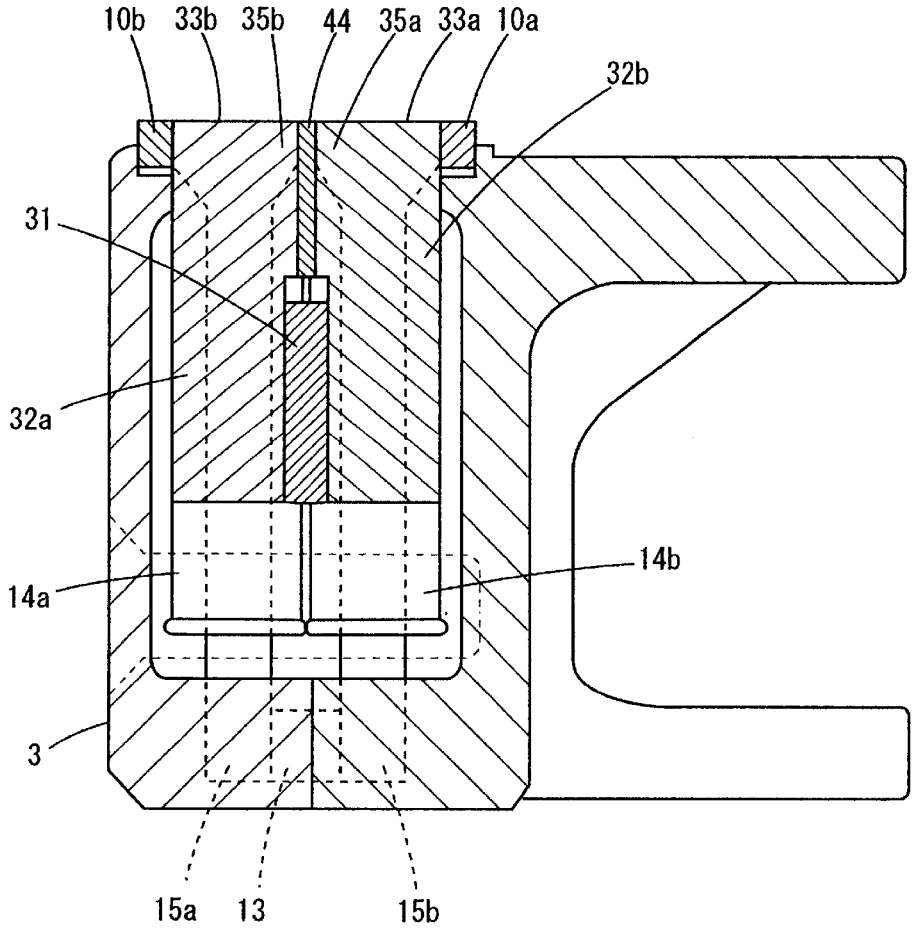
FIG. 3 shows a sectional view of the same taken along line iii—iii of FIG. 1.
Figure 4:
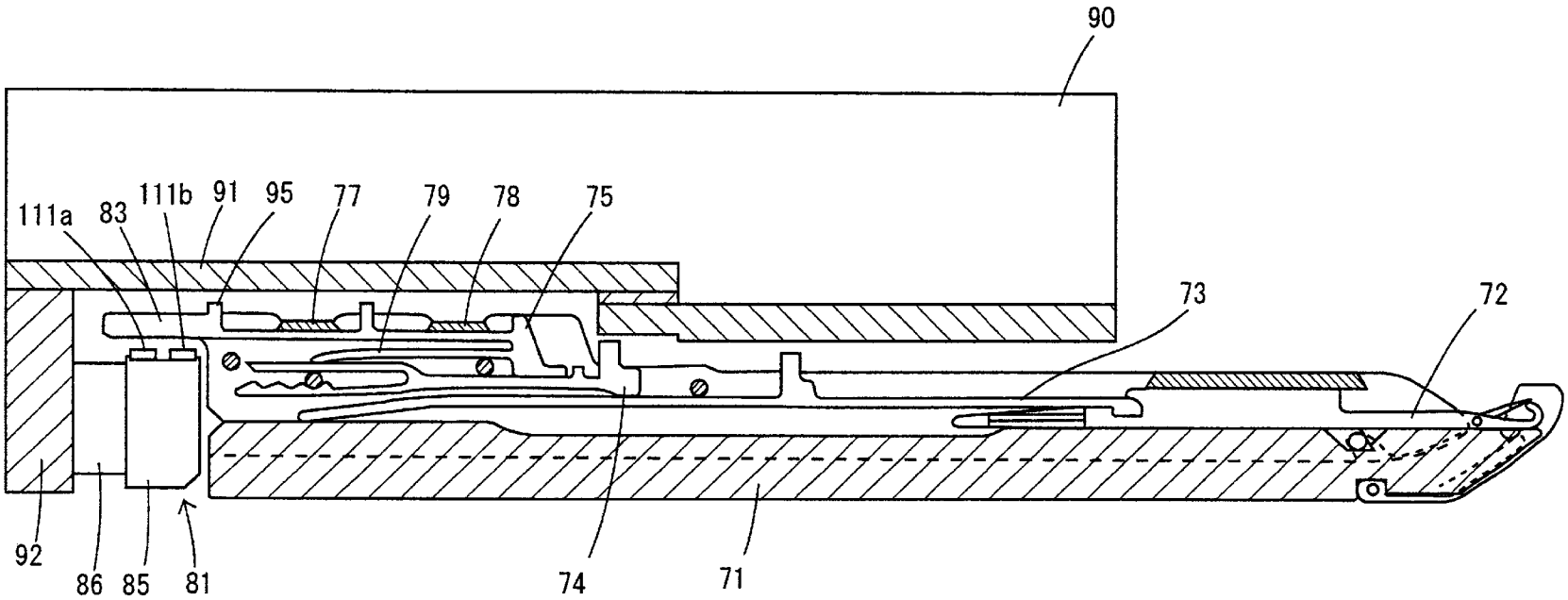
FIG. 4 shows a longitudinal sectional side elevation view of a needle bed and a carriage of a flat knitting machine with the needle selection actuator.
Figure 5:
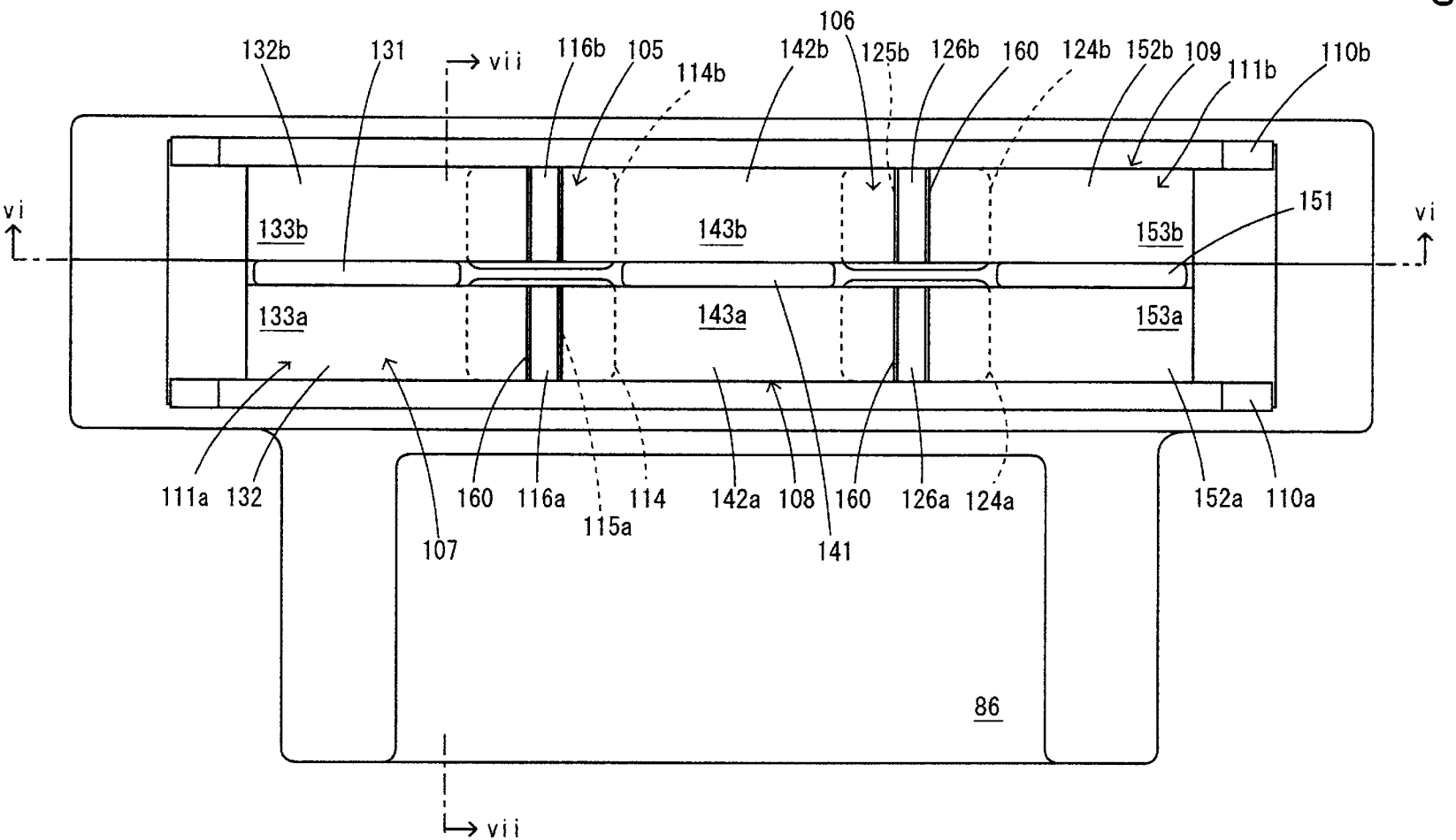
FIG. 5 shows a view of a conventional needle selection actuator as viewed from the attraction surface side.
Figure 6:
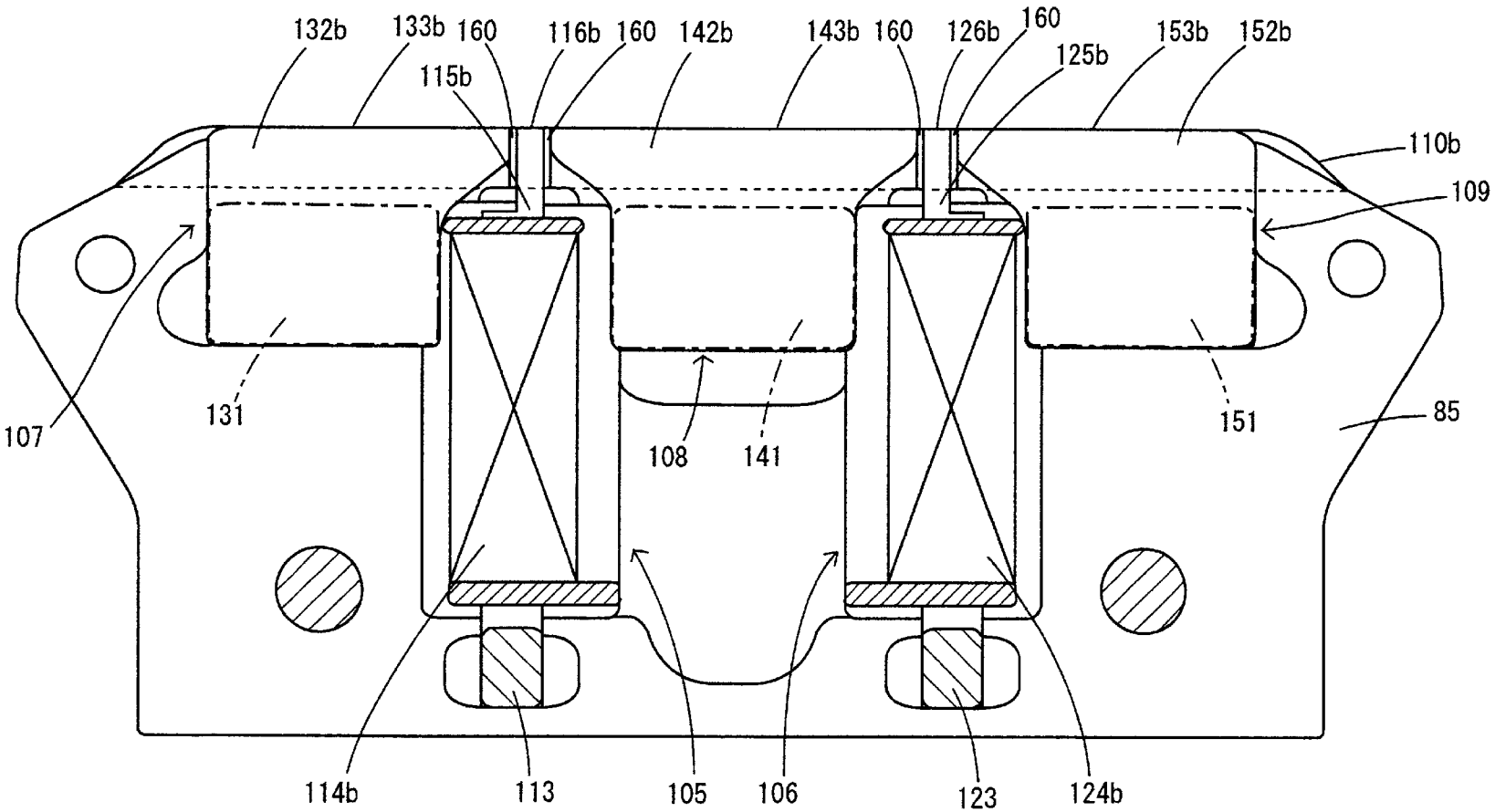
FIG. 6 shows a sectional view of the same taken along line vi—vi of FIG. 5.
Figure 7:
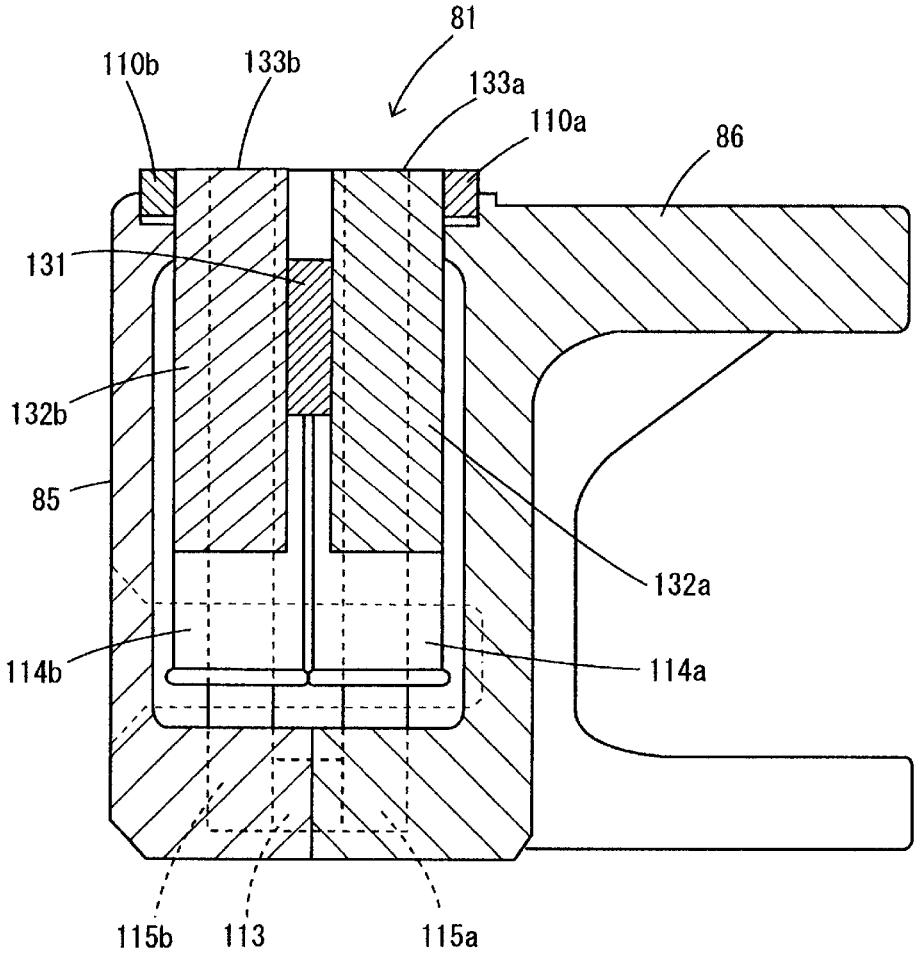
FIG. 7 shows a sectional view of the same taken along line vii—vii of FIG. 5.

A certain preferred embodiment of the present invention wherein a selection actuator for a knitting member is applied to a needle selection will be described with reference to the accompanying drawing figures. FIGS. 1–3 show the needle selection actuator 1. As the structures of the carriage and the needle bed of the flat knitting machine are all the same as that of FIG. 4, except the needle selection actuator, the illustration is omitted.

Two controlled attraction regions (a first controlled attraction region 5 and a second controlled magnetic part 6) and three uncontrolled attraction regions 7, 8, 9 are housed in a case 3 of a needle selection actuator 1, for three needle-selection positions for knit, tuck and miss. Each of the attraction regions 5–9 has flat attraction surfaces 11*a* (33*a*, 16*a*, 43*a*, 26*a*, 53*a*) and 11*b* (33*b*, 16*b*, 43*b*, 26*b*, 53*b*) arranged in two rows at sides thereof confronting an armature of a selector.

Each controlled attraction region 5, 6 comprises a permanent magnet 13, 23 disposed on a base of the case 3 and coil magnetic poles 15*a*; 15*b*, 24*a*; 24*b* which are arranged in parallel to sandwich the permanent magnet 13, 23 therebetween and around which coils 14*a*; 14*b*, 24*a*; 24*b* are wound. The coil magnetic poles 15*a*; 15*b*, 25*a*; 25*b* have attraction surfaces to attract the armature of the selector 16*a*, 16*b* (first needle selection part) and 26*a*, 26*b* (second needle selection part) formed on front ends thereof.

The uncontrolled attraction regions 7–9 comprise permanent magnets 31, 41, 51 and a pair of side yokes L 32*a*, 32*b*, a pair of side yokes R 52*a*, 52*b* and a pair of center yokes 42*a*, 42*b*. 33*a*, 33*b*, 43*a*, 43*b*, 53*a*, 53*b* denote attraction surfaces formed on front ends of the yokes of the uncontrolled attraction region, respectively. One of the attraction surfaces 33*a*; 33*b*, 43*a*; 43*b* and 53*a*; 53*b* are magnetized as the N-pole and the other are magnetized as the S-pole by their respective permanent magnets 31, 41, 51. Copper plates 60 thinner than the selector are inserted in between the attraction surfaces of the controlled attraction regions 5, 6 and the uncontrolled attraction regions 7–9, to prevent the magnetic fluxes generated in the uncontrolled attraction regions from leaking to the attraction surfaces 16, 26 of the adjacent controlled attraction regions, so as to present the five magnetic attraction regions 5–9 mentioned above in the form of independent magnetic circuits. The copper plates have a thickness to allow the selector to be carried to the attraction surface of the next controlled or uncontrolled attraction region beyond the copper plates in the state in which the selector is magnetically attracted to the attraction surface. Preferably, the copper plates have a thickness of not more than one-second thickness of the selector. In place of the copper plates, nonmagnetic material or void may alternatively be used.

It should be noted that the respective yokes which are magnetized as the S-pole and the N-pole and confronting each other have, at their parts on the attraction surface side, a thick-walled part 35*a*, 35*b*, 45*a*, 45*b*, 55*a*, 55*b* formed to extend along a widthwise direction of the attraction surface so that the interval between the yokes in the thick-walled part can become smaller than in the remaining parts, as shown in FIG. 2. The yokes have the magnetic property that a magnetic reluctance between the thick-walled parts 35*a*, 45*a*, 55*a*, 35*b*, 45*b*, 55*b* formed on the confronting yokes of the uncontrolled attraction region is larger than a magnetic reluctance between the attraction surface and the selector attracted thereto and also smaller than a magnetic reluctance between the yokes of the uncontrolled attraction region and the attraction surfaces 16*a*; 26*a*, 16*b*; 26*b* of the adjacent controlled attraction regions.

When the selector is not attracted to the attraction surface, the thick-walled parts 35, 45, 55 formed on the yokes 32, 42, 52 of the uncontrolled attraction regions work to allow a sizable percentage of magnetic flux of the permanent magnets to flow from one thick-walled parts 35*a*, 45*a*, 55*a* of the yokes to the opposed thick-walled parts 35*b*, 45*b*, 55*b* of the yokes, so as to feed the magnetic flux back to the permanent magnets 31, 41, 51. When the selector is attracted to the attraction surfaces 33, 43, 53 of the yokes, the magnetic flux generated by the permanent magnets 31, 41, 51 is allowed to flow not only to the selector but also to the opposed yokes, passing through the thick-walled parts of those yokes, so as to be fed back to the permanent magnets 31, 41, 51. 44 denotes a spacer made of copper inserted in between the confronting attraction surfaces of the S-pole and the N-pole to extend throughout the widthwise direction of the attraction surfaces, and 10*a*, 10*b* denote protectors.

The needle selection actuator 1 thus constructed operates as follows for needle selection. Suppose that the carriage travels leftwards. First, the selector is displaced by the return cam mounted on the carriage against the biasing force and is brought into abutment with the attraction surfaces of the needle selection actuator. In the uncontrolled attraction regions 7, the magnetic flux of the permanent magnet 31 flows from the attraction surface 33*a* of the side yoke 35*a* on the N-pole side to the attraction surface 33*b* of the side yoke 35*b* on the S-pole side through the selector. Thus, the selector can be magnetically attracted to the attraction surface and held thereon. When the carriage travels in this state and the selector is led to the position over the attraction surface 16 of the controlled attraction region 5 (first needle selection part), the coil magnetic pole 15 is energized for demagnetization, so as to release the selector from the attraction surface 16.

Whether or not the coil magnetic pole is energized, a sizable percentage of magnetic flux generated by the permanent magnet 31 of the uncontrolled attraction region 7 can be bypassed by the thick-walled part 35*a* formed on the side yoke L 32*a* so as to flow to the opposed thick-walled part 35*b* of the side yoke L 32*b*. As a result of this, the leakage of the magnetic flux from the attraction surface 33*a* to the attraction surface 16*a* of the adjacent controlled attraction region 5 can be suppressed to reduce the disadvantage of the selector being attracted to and held on the attraction surface 16*a* by the leakage of the magnetic flux. The operation mentioned above works on the confronting attraction surface on the S-pole side as well. As a result of this, the coil current range of the controlled attraction region 5 required for the release of the selector can be reduced or the required coil current can be kept constant.

Although the selectors to be attracted to the attraction surfaces of the uncontrolled attraction regions are small in number, since the magnetic reluctance between the thick-walled parts of the confronting side yokes L is made to be smaller than the magnetic reluctance between the thick-walled parts of the side yokes L and the adjacent controlled attraction regions, the leakage of the magnetic flux from the attraction surface of the uncontrolled attraction region serves to prevent the magnetic flux generated by the permanent magnet from leaking to the attraction surface of the adjacent controlled attraction region, and as such can allow the magnetic flux generated by the permanent magnet to flow into the opposed side yoke through the thick-walled parts. Hence, even when the selectors attracted are small in number, the selectors are not affected so significantly by the leaked magnetic flux, and as such can aloe the selector to be released without any need of a large current value, differently from the prior art.

Further, since a part of the thick-walled part of the yoke is extended to the attraction surface, the contact area of the attraction surface with the armature of the selector attracted is enlarged to the extent corresponding to the thick-walled part. This enables the selector to be attracted further reliably. This can provide an advantage for a large relative roughness of, for example, the attraction surface or the surface of the armature of the selector. The operation and effect mentioned above can be equally provided in the case where the selector attracted in the next uncontrolled attraction region 8 is released in the second need selection part 26. Also, when the carriage is reversed in traveling direction and travels rightwards, the same operation is provided.

While the present invention has been described above, the present invention is not limited to the embodiments illustrated above. Various changes and modifications may be made in the present invention without departing from the spirit and scope thereof. For example, although a part of the yoke is thickened along the widthwise direction of the attraction surface, so as to form the magnetic property part in the above-illustrated embodiment, as a substitute for this, a spacer made of magnetic material having the magnetic property required for providing the operation and effect of the present invention may be disposed between the yokes.

Capabilities of Exploitation in Industry

According to the present invention, there is no need to make a control of electric current value to allow for leakage of the magnetic flux or make a feedback control of detecting leakage of the magnetic flux by provision of a sensor and feeding back that leaked magnetic flux. Thus, the current range of the coil control current required for the release of the selector can be reduced or the required coil current can be kept constant.

What is claimed is:

1. A knitting member selection actuator of a knitting machine comprising at least one controlled attraction region in which a pair of coil magnetic poles, each having an attraction surface at a front end thereof, are arranged in parallel to sandwich a permanent magnet therebetween and an uncontrolled attraction regions which are placed at lateral sides of the controlled attraction region and in which a pair of yokes, each having an attraction surface at a front end thereof, are arranged in parallel to sandwich a permanent magnet therebetween and no coil magnetic pole is included in their magnetic circuit, wherein the pair of coil magnetic poles of the controlled attraction region are energized to cancel out magnetic flux of the attraction surfaces generated by the permanent magnet, so as to release a knitting member, such as a selector, from the attraction surfaces, so as to select the knitting member, and wherein there is provided between the pair of yokes magnetic property means for making a magnetic reluctance between the confronting yokes of the uncontrolled attraction region larger than a magnetic reluctance between the yokes of the uncontrolled attraction region and the knitting member attracted to the attraction surfaces and also smaller than a magnetic reluctance between the yokes of the uncontrolled attraction region and the attraction surfaces of the adjacent controlled attraction region.

2. The knitting member selection actuator of the knitting machine according to claim 1, wherein the magnetic property means is formed by a part of each yoke being thickened along a widthwise direction of the attraction surface to form a thick-walled part therealong so that an interval between the confronting yokes in the thick-walled part can be smaller than in the remaining parts.

3. The knitting member selection actuator of the knitting machine according to claim 1, wherein the magnetic property means is formed by a spacer disposed between the confronting yokes.

4. The knitting member selection actuator of the knitting machine according to claim 2, wherein the magnetic property means is provided along the attraction surface in such a manner as to form a part of the attraction surface.

* * * * *